US006102758A

United States Patent [19]

Smith et al.

[11] Patent Number: 6,102,758

[45] Date of Patent: Aug. 15, 2000

[54] NEAR SHORE SPAR COMMUNICATION PLATFORM

[75] Inventors: C. W. Sinjin Smith, Palm Bay; Edward V. Enders, Viera, both of Fla.

[73] Assignee: Harris Corporation, Melbourne, Fla.

[21] Appl. No.: 09/170,613

[22] Filed: Oct. 13, 1998

Related U.S. Application Data

[60] Provisional application No. 60/076,890, Mar. 5, 1998.

[51] Int. Cl.[7] ..... B63B 22/00

[52] U.S. Cl. ..... 441/1; 441/11; 441/21; 441/23

[58] Field of Search ..... 441/1, 21, 11, 441/22–26, 32, 33; 114/90, 265, 326, 328, 329; 455/40, 66; 340/984, 985

[56] References Cited

U.S. PATENT DOCUMENTS

| | | | |
|---|---|---|---|
| 1,408,868 | 3/1922 | Dutcher | 114/90 |
| 3,191,202 | 6/1965 | Handler | 441/22 |
| 3,405,558 | 10/1968 | Koot | 441/11 |
| 3,559,223 | 2/1971 | Lockwood et al. | 441/23 |
| 3,590,406 | 7/1971 | Lockwood et al. | 9/8 |
| 3,710,259 | 1/1973 | Kirby et al. | 325/187 |
| 5,452,262 | 9/1995 | Hagerty | 367/6 |
| 5,816,874 | 10/1998 | Juran et al. | 441/11 |

FOREIGN PATENT DOCUMENTS

| | | | |
|---|---|---|---|
| 56-157683 | 12/1981 | Japan | 441/21 |

*Primary Examiner*—S. Joseph Morano
*Assistant Examiner*—Ajay Vasudeva
*Attorney, Agent, or Firm*—Dennis L. Cook

[57] ABSTRACT

The Near Shore Spar Buoy Communication Platform is a semi-stable platform for data collection and retrieval for distances up to and over several miles offshore. It is an ocean-going computer housed in a modified spar buoy which is connected to a shore computer via a wireless Ethernet LAN. The Ethernet LAN is provided through use of wireless link technology capable of 2 to 11 megabits of bi-directional throughput and is expandable to higher data rates in the future. The platform behaves much like a spar buoy, which is essentially decoupled from waves and has a very small roll motion. An anti-heave appendage allows for the decrease of the heave motion normally associated with traditional spar buoys. The platform has a airfoil-like design which allows it to align itself with the current thus decreasing the overall yaw motion commonly associated with buoy communication platforms. This unique design allows the use of a single axis positioner rather than the three axis positioner used on present discus style communication buoys. This positioner allows for constant communication between the buoy and the shore station. Also, the platform's sectioned design allows it to be deployed from small water craft in various water depths. Multiple Near Shore Spar Buoy Communication Platforms can be deployed over a region and networked together in the same Ethernet LAN.

12 Claims, 4 Drawing Sheets

NEAR SHORE SPAR COMMUNICATION PLATFORM

CROSS-REFERENCE TO RELATED APPLICATION

The present application claims the benefit of previously filed co-pending Provisional Patent Application, Ser. No. 60/076,890 filed Mar. 5, 1998.

FIELD OF THE INVENTION

The present invention is a semi-stable platform for data collection and retrieval for distances up to and over several miles offshore and in particular relates to the stabilization, by damping the surface and current forces acting on the platform, of near shore surface buoy communication platforms used for Local Area Networks (LANs) and thereby preventing loss of signal by movement of the platform.

BACKGROUND OF THE INVENTION

The use of buoys for communication platforms for off shore and near shore communication is well known in the art but maintaining constant communication between such platforms, or between such platforms and the shore, such as would be required to have an Ethernet Local Area Network (LAN) operating, has been difficult and expensive due to the constant up and down movement (heave), side to side movement (roll), and rotating movement (yaw) of buoy communication platforms when the forces of waves and currents are exerted against them. This is particularly true near shore where these forces can be more exaggerated and changing.

Present off shore and near shore communication systems normally use discus buoys for the communication platform. Because of the flat nature of these buoys they ride on the top of and follow the waves. This creates the heave, roll, and yaw problems mentioned above and thus they generally require a minimum three axis positioner for signal aiming if any communications link is required to remain unbroken by misalignment of the signal. This is costly because it requires complicated positioning calculations and constant adjusting of the signal aiming device. They also have a strong potential for capsizing. Because of the problems with discus buoys, spar buoys, which are essentially decoupled from waves, are being looked at more often as a platform for off shore and near shore communication systems. But, they still have heave (although it is not as large), very little role, and yaw is still a problem. Numerous attempts to solve these problems have been disclosed in the prior art as shown by the following patents:

U.S. Pat. No. 4,004,308 discloses a stabilizing structure for a buoyant elongated cylindrical housing assembly tethered to an anchor on the bottom of a body of water. It includes a pair of positively buoyant arms hinged to the top of the housing at an angle to each other with leaf spring members and cables attached to the ends of the leaf spring members to limit the upward travel. The outwardly extending arms have an airfoil-like cross section and assume a trailing position relative to any current in the water with the current bisecting an angle between the arms. This arrangement causes the arms to exert a lifting force tending too both rotate the housing toward the vertical around its point of attachment with the tethering line attached to its lower end in opposition to the tilting force exerted by the current and also to positively lift the housing to a higher position more nearly over the anchor. A pair of tip fins may be used to counter forces tending to move the assembly in yaw. A pair of short strips may be attached along the sides of the housing to minimize vortex shedding effects.

U.S. Pat. No. 5,108,326 relates generally to the stabilization of drifter buoys and the like and more particularly to surface or near surface Langrangian Drifter Buoys launched from aircraft or surface vehicles. It uses a underwater suspension system adapted for stabilizing and maintaining the buoy at a predetermined depth in an upright position. The suspension assembly for use in combination with a buoy, having a generally elongated cylindrical hull, is comprised of two main components including 1) a collapsible longitudinal stabilizer for providing horizontal drag and 2) a vertical stabilizer suspended below and transverse the axis of the buoy. These two components act together to maintain the buoy in an upright position and to maintain it within the layer of water in which it is placed.

U.S. Pat. No. 3,755,836 discloses an invention which works with a communications buoy of the type launched from a submerged vessel. It has an automatically deployable surface stabilization arrangement for preventing inundation of the buoy even under severe conditions. This arrangement is a collar of continuous and flexible material such as mylar film arranged around the buoy proximate to the water line, and attached to the buoy via the top portion in substantially leak-proof manner with the bottom portion open in a conical or umbrella-like fashion. The collar is rapidly deployed by a series of spring-loaded or bowed arms fabricated of a resilient material and spaced from one another around the buoy. Release of the force constraining the arms against the buoy, such as occurs upon launch of the buoy from the submerged vessel, permits the collar to automatically deploy, thus forming around the buoy at the water line a pocket to trap air. Spring-loaded fins may also be provided on a submerged portion of the buoy remote from the collar to provide broad surfaces for further damping of the forces acting on the buoy.

U.S. Pat. No. 5,387,144 also discloses a spar buoy in which a buoyancy body is provided halfway on a marker mast, the lower end of the marker mast being pulled in the water so that the water line comes to halfway on the marker mast above the buoyancy body. The spar buoy is made up of at least two arms which protrude in opposite directions to each other from the marker mast below the buoyancy body, with blades attached to the end of each arm so they have a positive angle of attack toward the center of the buoy.

The limitations of the prior art are clear. They generally attempt to use deployable or fixed mechanisms; either arms or parachute like films, around the buoy. These mechanisms are complicated and would tend to be expensive to manufacture and maintain. What is needed by the scientific and research communities is a simple stabilized buoy communication platform which is easy to deploy and maintain, and, is capable of maintaining a constant communications link with a simple one axis positioner. This invention supplies such a platform.

SUMMARY OF THE INVENTION

The present invention has been made to solve the problems described above. The Near Shore Spar Buoy Communication Platform is an ocean-going computer housed in a modified spar buoy which is connected to a shore computer via a Wireless Ethernet LAN. The Ethernet LAN is provided through use of wireless link technology. The wireless link is capable of 2 to 11 megabits of bidirectional throughput and is expandable to higher data rates in the future. Thus the Near Shore Spar Buoy Communication Platform is a semi-stable platform for data collection and retrieval for distances up to and over several miles offshore. Multiple Near Shore Spar Buoy Communication Platforms can be deployed over a region and networked together in the same wireless Ethernet LAN.

The Near Shore Spar Buoy Communication Platform is a modified spar buoy, which is essentially decoupled from waves and has a very small roll motion. The Near Shore Spar Buoy Communication Platform has an airfoil-like design which allows it to align itself with the current thus constraining the overall yaw motion. This design allows the use of a single axis positioner rather than the usually required three axis positioner used on present discus style communication buoys. Spar buoys still have heave, but through the use of an anti-heave appendage the magnitude of the motion is decreased. Though much decreased, but still occurring, the yawing motion is compensated for by the use of a single axis positioner that maintains a signal lock for the wireless communication link allowing the Ethernet LAN to be operated even is severe conditions. This positioner, in conjunction with a wide beamwidth antenna, allows for constant communication between the buoys and the shore station. The Near Shore Spar Buoy Communication Platform's sectioned design allows it to be deployed from small water craft in various water depths.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

The buoy communication platform of the present invention can be used in many applications where a constant communication link is required and one of the communicating or receiving devices is required to be placed in a body of water. The embodiment disclosed here is intended for use in the scientific and research communities for collection of data regarding environmental systems near the shore of a body of water. It can also be used by government or civilian agencies for surveillance or other information gathering purposes. This invention allows constant collection and on-shore monitoring of such data through use of a Wireless Ethernet LAN connecting the communication platform (or numerous communication platforms) to one or multiple shore stations.

Figure 1:
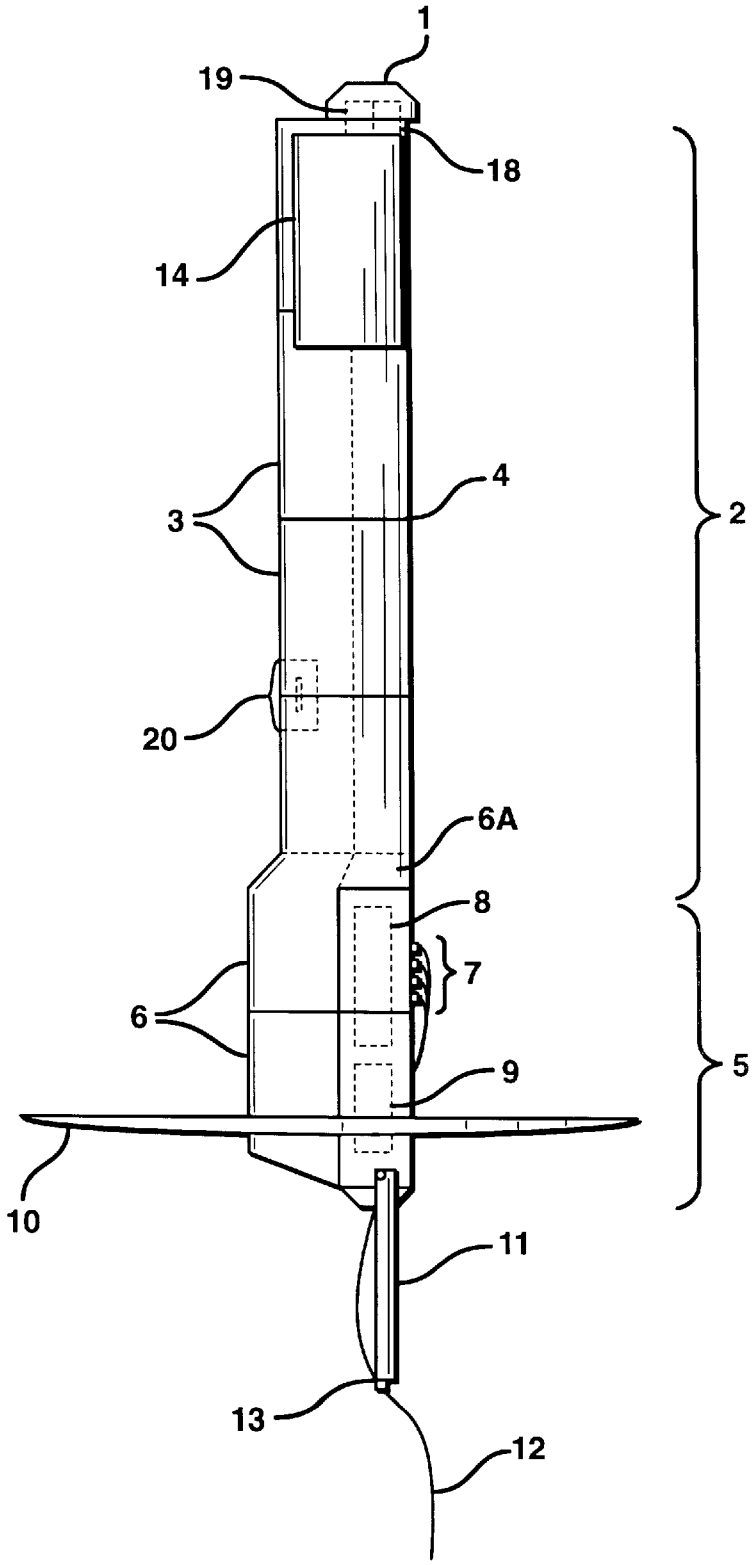
FIG. 1 is a block diagram showing the basic configuration of the Near Shore Spar Buoy Communication Platform in its preferred embodiment with the electronic assemblies incorporated into the buoy structure.
Figure 2:
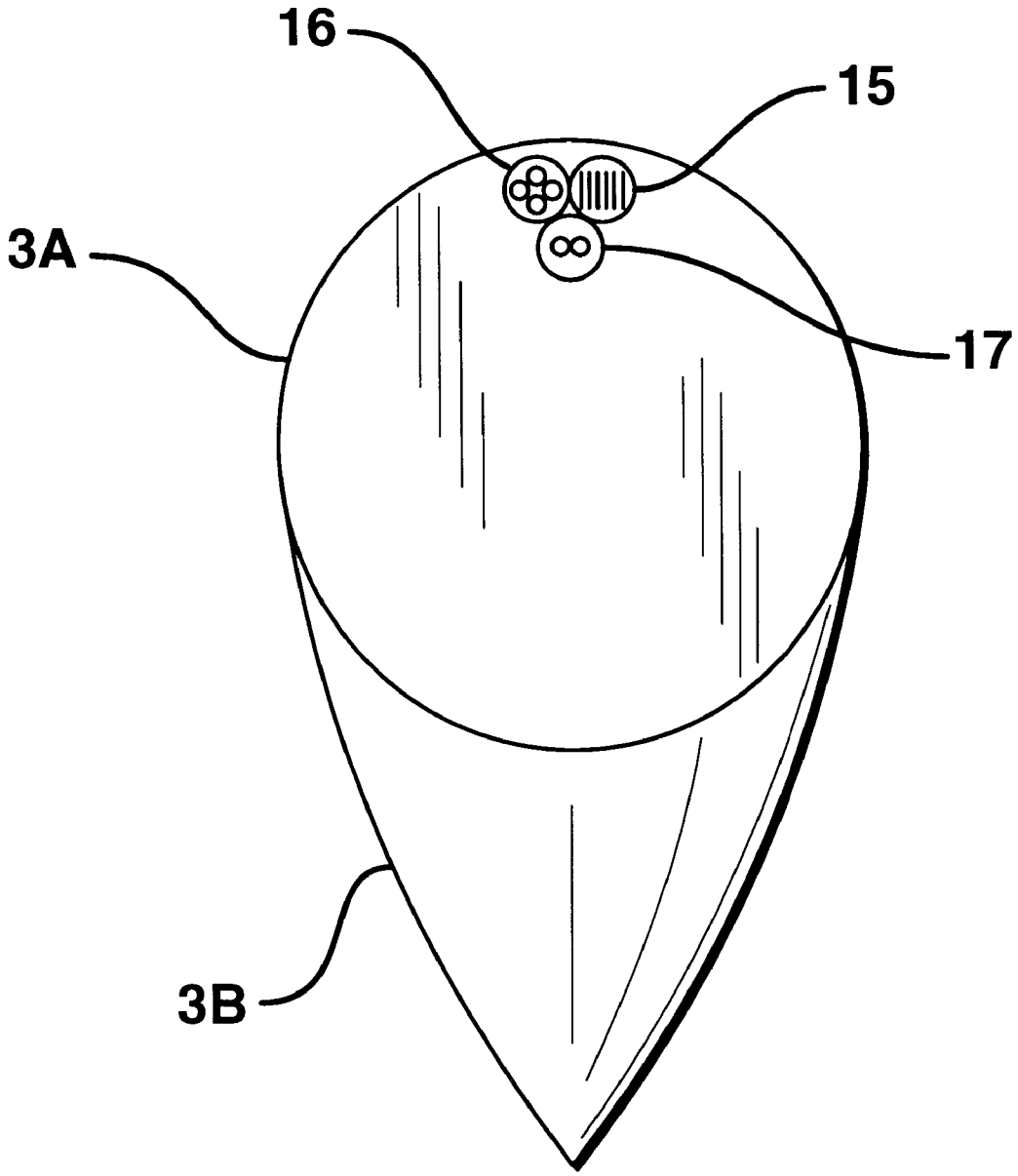
FIG. 2 is a top view cross section of the main body of the buoy structure disclosing its airfoil-like shape.

The buoy communication platform has the capability of serial, analog, digital, and video inputs. Audio can also be connected. The user can install any software that is compatible with Windows or DOS operating systems on the buoy communication platform to control and monitor sensors or devices located in the water. The software can be configured to output data to a file and the file can be stored either locally on the on board computer's hard drive or be written to an external drive located elsewhere on the network. The buoy communication platform can be set up as a standard client on a server and have data shared across the network. A shore station computer could also have a server installed to allow multiple computer access to the wireless LAN network containing the buoy communication platform The buoy communication platform for use in a near shore wireless Ethernet LAN is shown in FIG. 1. The spar buoy itself is shown in its simplest form in FIG. 3. The buoy has the typical elongated cylindrical shape but has some features not normally found on spar buoys. FIG. 2 discloses the airfoil-like cross sectional shape of the spar area (2). This area is constructed with use of PVC pipe **(3*a*) having a radius of five (5) inches. Attached to each side of the PVC pipe (3*a*), directly across from each other, are two pieces of semi-rigid material (3*b*) with a convex curving shape such that they extend back from the sides of the PVC pipe (3*a*) and meet at a distance approximately twice the radius of the PVC pipe (3*a*), thus forming an approximate V shape where they meet. This gives the spar buoy a airfoil-like cross sectional shape. Still referring to FIG. 3 an expanded spar area (5)** of the spar buoy is located at the bottom of the spar buoy and occupies approximately one quarter (¼) of the length of the spar buoy. This increased size is accomplished by using PVC pipe having a radius of nine (9) inches and correspondingly longer side pieces.

Figure 4:
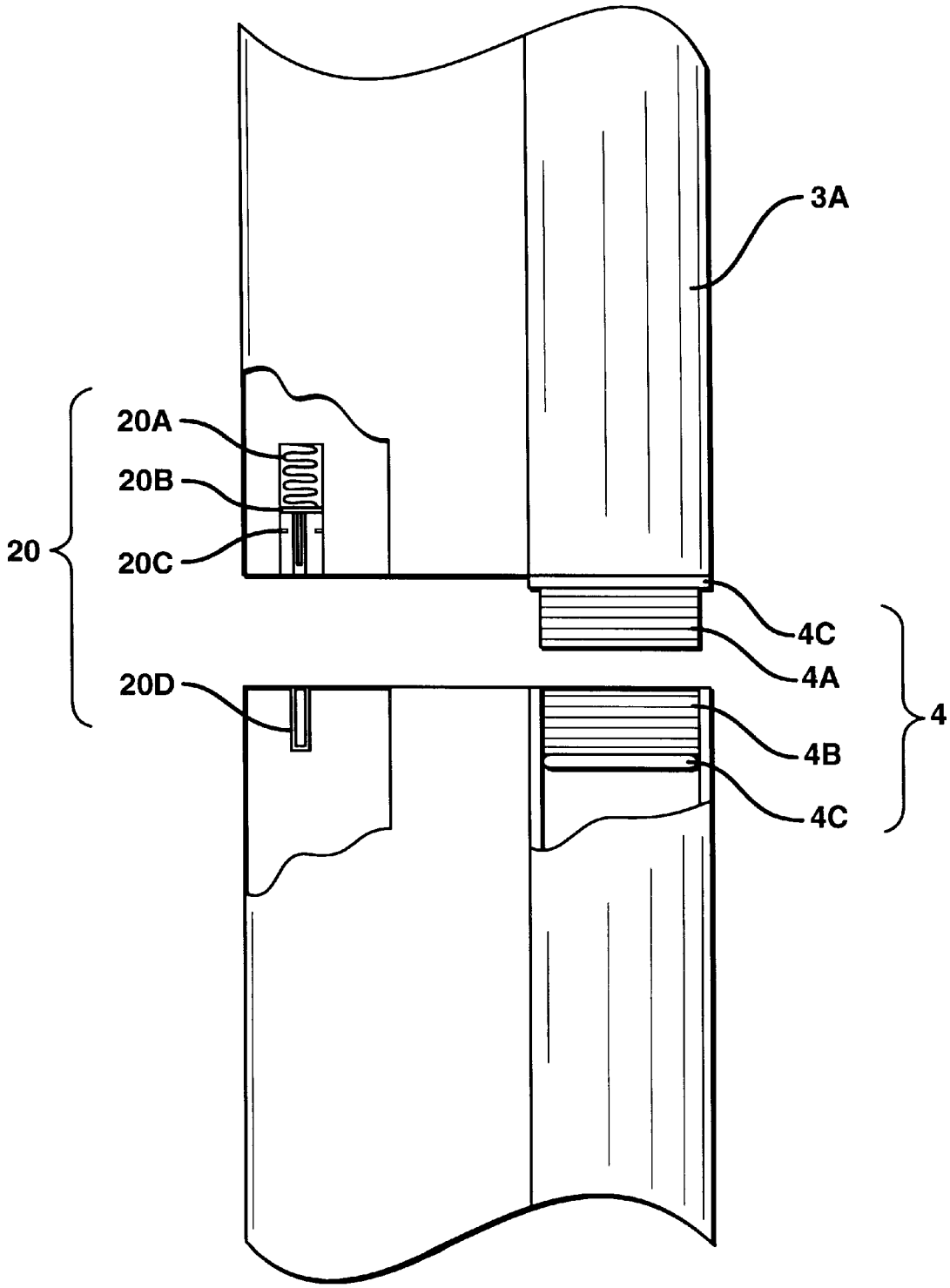
FIG. 4 is a blown up view of the joining and locking mechanism allowing for easy deployment of the buoy from small water craft.

Returning to FIG. 1 of the preferred embodiment of the buoy communication platform one can see that for ease of deployment from even small water craft the spar buoy is actually made up of shortened length spar sections (3&6) for both the spar area(2) and expanded spar (5) areas. These sections are joined together upon deployment through use of the watertight joining mechanism (4) shown in FIG. 1. The details of this joining mechanism are shown in FIG. 4. FIG. 4 clearly shows that each end of the PVC pipe **(3*a*) of the spar sections (3) and expanded spar sections (6) have threaded ends. One end has male threads (4*a*) on the outside of the pipe, and the other end has female threads (4*b*) on the inside. The threaded portions are the same length on each end. O-rings (4*c*) are placed at the junctions where the threading stops and the smooth portion of the pipe (3*a*) begins. When the sections are screwed together a watertight seal is formed. To connect the lowermost spar section (3) to the uppermost expanded spar section (6) a reducing coupling (6*a*) is used. This reducing coupling is also constructed of PVC material and has the same threaded end and O-ring configuration of the spar sections (3) and expanded spar sections (6)**.

After the spar sections (3 & 6) are screwed together a locking mechanism (20) is used to keep the side sections **(3*b*) aligned. This locking mechanism (20) is positioned within and attached to the side sections (3*b*). The locking mechanism (20) uses a nonmetallic spring (20*a*) resting on a piston (20*b*) with a plunging arm of Ferrous-material extending downward. The piston (20***b*) is manually pushed upward compressing the spring (20*a*) while the spar sections (3 & 6) are screwed together. After the spar sections (3 & 6) are screwed together the plunging arm (20*c*) is released and it moves downward until stopped by a stop ring (20*c*). When extended fully downward the Ferrous-plunging arm of the piston (20*b*) inserts into a locking cylinder (20*d*) located in the adjacent spar section (3 & 6). To unlock the spar sections (3 & 6) a magnet is used to raise the plunging arm of the piston (20*b*) out of the locking cylinder (20*d*) such that the spar sections (3 & 6) can be unscrewed.

Figure 3:
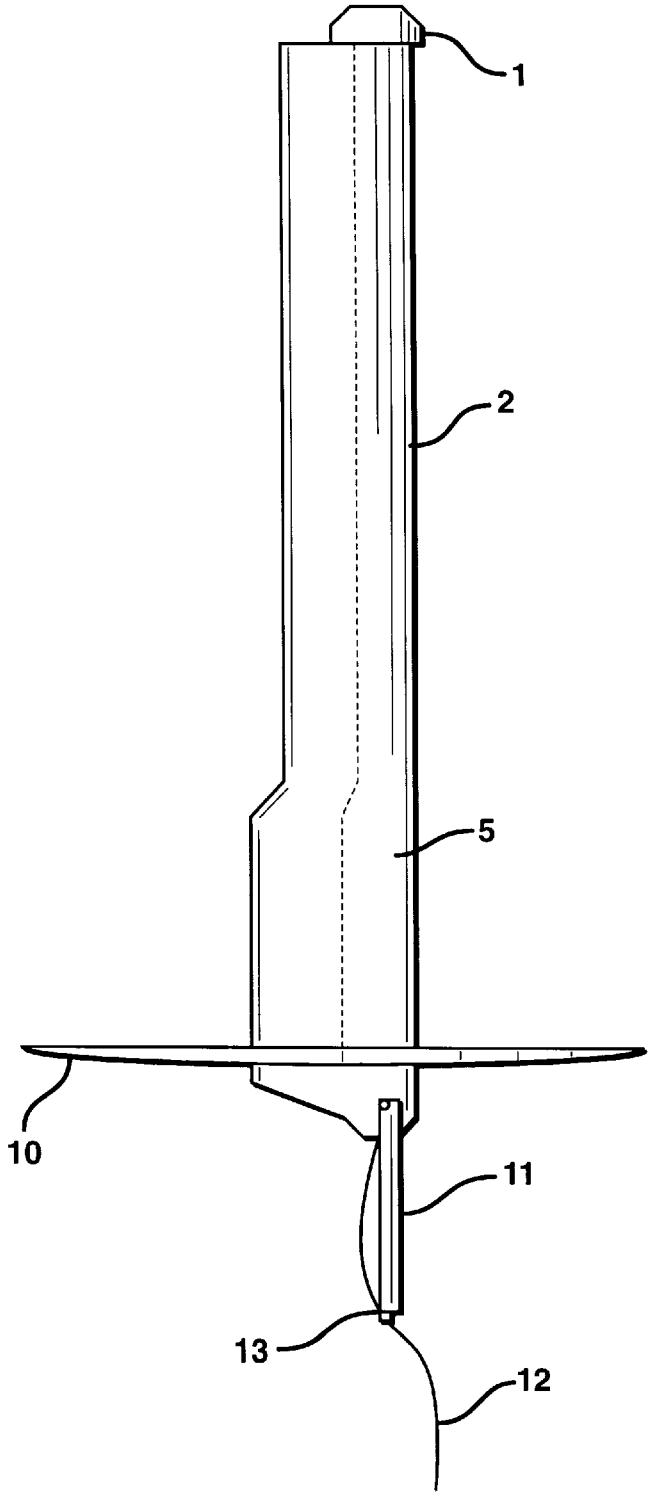
FIG. 3 is a side diagram of the buoy structure showing its basic shape and length.

Looking again at the basic buoy spar structure of FIG. 3 one can see that an anti-heave appendage (10) is located near the bottom of the expanded spar area (5) of the spar buoy. This anti-heave appendage can be of any style or type which are well known to those skilled in the art. The anti-heave appendage (10) used on the buoy communication platform disclosed in FIG. 1 consists of two semi-circular halves made of a semi-rigid material which are clamped or bolted together around the expanded spar area (5) thus creating a round shape, having a radius of approximately three times the radius of the PVC pipe (3*a*) used in the expanded spar sections (6).

Located at the bottom of the spar buoy of FIG. 3 is a mooring system (11, 12 &13) which is attached in any number of ways to the bottom of the spar buoy. But, in the buoy communication platform shown in FIG. 1 the metal mooring bail (11) has a U joint at the top and is mechanically bolted to the bottom of the spar buoy such that it is free to swing towards the front or back of the spar buoy. Attached to the mooring bail (11) is a swivel, (13) and mooring line (12), which secures to any anchoring device.

Now, having completed the description of the spar buoy configuration which stabilizes the communication platform such that wireless Ethernet LAN connections are possible with a single axis positioner the reader is directed back to FIG. 1 for a more complete description of the electrical and electronics portion of the buoy communication platform. At the top of the spar buoy a radome (1) which encloses the antenna used to radiate and receive the wireless LAN signals, and a single axis positioner (19) which aims the antenna, are attached. Also, the transmitter/receiver (18) is located just below the positioner. Any suitable radome and positioner which are strong enough to withstand the particular environmental stresses of the location chosen for the buoy communication platform can be used and these are well known to those skilled in the art. In the preferred embodiment disclosed here a fiberglass radome (1) tuned to 2.4 GHz is used. The single axis positioner is a common marine turntable style positioner. The antennas selected will also be dictated by the particular use of the buoy communication platform envisioned, and any suitable antenna or antenna combination may be used with the appropriate radome. In the disclosed buoy communication platform a 2.4 GHz Yagi wide beamwidth antenna is used. The transmitter/receiver is designed or selected to match the particular bandwidth and antenna type and are well known to those skilled in the art.

Attached to the spar buoy in the spar area (2) just below the positioner (19) is a panel of solar cells (14). These solar cells are used to charge batteries located in the battery pod (9) of the buoy communication platform. The battery pod (9) is located in one of the expanded spar sections (6) near the bottom of the buoy communication platform. The panel of solar cells (14), the batteries in the battery pod (9), the transmitter/receiver (18), and the single axis positioner (19) are connected by standard two-pair copper wire (16) which runs inside the spar sections (3) and expanded spar sections (6) to supply power to the these devices. The power is controlled by a controller located in the electronics pod (8). The correct combination of solar cells and batteries is dependent on the exact use of the buoy communication platform and suitable combinations can be selected by anyone skilled in the art. For the particular buoy communication platform disclosed here a solar cell panel consisting of six amorphous silicon solar cells, each measuring 51 inches by 13 inches, and each having an output of 55 watts of power to charge the absorbed glass-mat batteries configured as secondary or a combination of primary and secondary batteries. The controller can be any commercially available solar power controller well known to those skilled in the art.

Also, as shown in FIG. 2, running the length of the spar buoy, inside the PVC pipe (3*a*), from the transmitter/receiver (18) and down into the expanded spar area (5) is a shielded twisted pair cable (17) to transfer electronic signals back and forth from the electronics pod (8) which is located in the expanded spar area (5) just above the battery pod (9) to the transmitter/receiver (18). Also running the length of the spar buoy is a low loss coaxial cable (15) which is used to transfer the RF signals to and from the antenna in the radome (1) through the transmitter/receiver (18), and to the electronics pod (8). The electronics pod (8) contains the electronic equipment used on the buoy communication platform. Numerous varieties and combinations of electronic equipment can be included in the electronics pod (8). The electronics pod (8) of the buoy communication platform as disclosed in this preferred embodiment contains a PC104 single board computer with analog and digital boards, and a PCMIA adapter with a wireless radio LAN card such as the Harris PRISM card.

Finally, returning to FIG. 1 for the preferred embodiment of the buoy communication platform, there are electronic connectors (7) located on the outside of the electronics pod (8) to connect the following inputs among others:

RS-232 serial ports—Impulse connectors: LPBH-9-FS (9 pin, low profile)

RS-232/422/485 configurable serial port—impulse connector: LPBH-9-FS (9 pin, low profile)

Multi-input analog port- Impulse connector: MBH-16-FS (16 pin)

Multi-input/output digital ports - Impulse connectors: LPBH-9-FS (9 pin, low profile)

Video input port—Impulse connectors: LPBH-4-FS (4 pin, low profile)

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the dependent claims.

What is claimed is:

1. A buoy communication platform comprising:

a spar buoy, said spar buoy having an elongated airfoil shape such that the front half has a circular profile and the back half has sides which extend back from the sides of a circle formed by the front half to a distance of at least twice the length of the radius of the circle with the extended sides curving toward each other ending in a approximate V shape where the extended sides meet behind the center of the circle, creating an airfoil cross section;

an electronics pod, said electronics pod containing communications and sensor electronics, said electronics pod attached to said spar buoy;

a power means for supplying power to said electronics pod, said power means being an energy storage device for storing energy, said energy storage device attached to said spar buoy;

a charging means to charge said energy storage device, said charging means attached to said spar buoy;

a radiating and receiving means for transmitting and receiving electromagnetic signals, said radiating and receiving means attached to one end of said spar buoy;

a mooring means for securing said spar buoy at a selected location, said mooring means attached to said spar buoy at the end opposite said radiating and receiving means; and an anti-heave means for damping the heaving motion of said spar buoy, said anti-heave means being a thin flat circular disk of lightweight semi-rigid material having a radius at least as large as two times the radius of the cylindrical profile of the front side of said spar buoy, said anti-heave means attached to said spar buoy above said mooring means.

2. The buoy communication platform of claim 1 also comprising:

electronic connectors for connection of sensors, said electronics connectors located on the outside surface of said spar buoy.

3. A buoy communication platform comprising:

a spar buoy, said spar buoy having a spar buoy area and an expanded spar buoy area;

said spar buoy area having an elongated airfoil shape such that the front half has a circular profile and the back half has sides which extend back from the sides of a circle formed by the front half to a distance of at least twice the length of the radius of the circle with the extended sides curving toward each other ending in an approximate V shape where the extended sides meet behind the center of the circle, creating an airfoil cross section;

said expanded spar buoy area located at the bottom portion of said spar buoy, said expanded spar buoy area having an elongated airfoil shape such that the front half has a circular profile larger than the size of the circular profile of said spar buoy area and the back half having sides which extend back from the sides of a circle formed by the front half of to a distance of at least twice the length of the radius of the circle with the extended sides curving toward each other ending in an approximate V shape where the extended sides meet behind the center of the circle creating an airfoil cross section;

an electronics pod, said electronics pod containing communications and sensor electronics, said electronics pod located in said expanded spar buoy area;

a power means for supplying power to said electronics pod, said power means being an energy storage device for storing energy, said energy storage device attached to said spar buoy;

a charging means to charge said energy storage device, said charging means attached to said spar buoy;

a radiating and receiving means for transmitting and receiving electromagnetic signals, said radiating and receiving means attached to upper end of said spar buoy area;

a mooring means for securing said spar buoy at a selected location, said mooring means attached to the bottom of said expanded spar buoy area; and an anti-heave means for damping the heaving motion of said spar buoy, said anti-heave means being a thin flat circular disk of lightweight semi-rigid material having a radius at least as large as two times the radius of the cylindrical profile of the front side of said spar buoy, said anti-heave means attached to said expanded spar buoy area above said mooring means.

4. The buoy communication platform of claim 3 also comprising;

electronic connectors for connection of sensors, said electronics connectors located on the outside surface of said expanded spar buoy area.

5. A buoy communication platform comprising:

a spar buoy, said spar buoy made up of spar sections;

said spar sections having an elongated airfoil shape such that the front half has a circular profile and the back half has sides which extend back from the sides of a circle formed by the front half to a distance of at least twice the length of the radius of the circle with the extended sides curving toward each other ending in an approximate V shape where the extended sides meet behind the center of the circle, creating an airfoil cross section;

a watertight connecting means on the each end of said spar sections for combining said spar sections into said spar buoy;

an electronics pod containing communications and sensor electronics, said electronics pod attached to said spar buoy;

a power means for supplying power to said electronics pod, said power means being an energy storage device for storing energy, said energy storage device attached to said spar buoy;

a charging means to charge said energy storage device, said charging means attached to said spar buoy;

a radiating and receiving means for transmitting and receiving electromagnetic signals, said radiating and receiving means attached to one end of said spar buoy;

a mooring means for securing said spar buoy at a selected location, said mooring means attached to said spar buoy at the end opposite said radiating and receiving means; and an anti-heave means for damping the heaving motion of said spar buoy, said anti-heave means being a thin flat circular disk of lightweight semi-rigid material having a radius at least as large as two times the radius of the cylindrical profile of the front side of said spar buoy, said anti-heave means attached to said spar buoy above said mooring means.

6. The buoy communication platform of claim 5 wherein said watertight connecting means is comprised of:

said spar sections having a cylindrical female threaded area on one end and a cylindrical male threaded area on the other end being of equal length to the female threaded area;

O-rings positioned at the lip formed at the juncture of the threaded areas of the spar section and the unthreaded areas of said spar section;

said spar sections being connected end to end by screwing the male threaded end of one spar section into the female threaded end of another spar section such that a watertight joining of said spar sections results; and a locking means to keep said spar sections from unscrewing once they are screwed together.

7. The buoy communication platform of claim 5 also comprising:

electronic connectors for connection of sensors, said electronic connectors located on the outside surface of said spar sections.

8. The buoy communication platform of claim 5 comprising:

expanded spar sections, said expanded spar sections having an elongated airfoil shape such that the front half has a circular profile having a radius of at least twice as large as the circular profile radius of said spar sections and the back half has sides which extend back from the sides of a circle formed by the front half to a distance at least twice the length of the radius of the circle with the extended sides curving toward each other ending in an approximate V shape where the extended sides meet behind the center of the circle, creating an airfoil cross section, said expanded spar sections located at the bottom portion of said spar buoy;

a watertight connecting means on the each end of said expanded spar sections for including said expanded spar sections into said spar buoy.

9. The buoy communication platform of claim 8 wherein the watertight connecting means comprises:

said expanded spar sections having a cylindrical female threaded area on one end and a cylindrical male threaded area on the other end being of equal length to the female threaded area;

O-rings positioned at the lip formed at the juncture of the threaded areas of said expanded spar section and the unthreaded areas of said expanded spar section;

said expanded spar sections being connected end to end by screwing the male threaded end of one expanded spar section into the female threaded end of another expanded spar section such that a watertight joining of expanded said spar sections results; and a locking means to keep said expanded spar sections from unscrewing once they are screwed together.

10. The buoy communication platform of claim 9 wherein said power means is comprised of:

an energy storage device for storing energy, said energy storage device located in one or more expanded spar sections; and a charging means for charging said energy storage device, said charging means attached to said spar buoy.

11. The buoy communication platform of claim 9 wherein said electronics pod is located in one or more expanded spar sections.

12. The buoy communication platform of claim 11 also comprising:

electronic connectors for connection of sensors, said electrical connectors located on the outside surface of said expanded spar section or sections containing said electronics pod.

* * * * *

UNITED STATES PATENT AND TRADEMARK OFFICE
CERTIFICATE OF CORRECTION

PATENT NO : 6,102,758
DATED : 8/15/2000
INVENTOR(S) : C.W. Sinjin Smith, Edward V. Enders It is certified that an error appears in the above-identified patent and that said Letters Patent are hereby corrected as shown below:

Title page, item [54],

The patent title is missing the word "BUOY".

The correct title name is NEAR SHORE SPAR BUOY COMMUNICATION PLATFORM.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*